US011002275B2

(12) United States Patent
Fullenkamp et al.

(10) Patent No.: US 11,002,275 B2
(45) Date of Patent: May 11, 2021

(54) COMPRESSOR WITH OLDHAM ASSEMBLY

(71) Applicant: Emerson Climate Technologies, Inc., Sidney, OH (US)

(72) Inventors: Paul L. Fullenkamp, Versailles, OH (US); Roxana E. L. Ruxanda, Troy, OH (US); Eric A. Maurer, Troy, OH (US); Jesús Ángel Nohales Herraiz, Aachen (DE); Francis Beckers, Verviers (BE); Vincent Cloosen, Waremme (BE); Laurent Grignard, Dison (BE)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

(21) Appl. No.: 16/555,413

(22) Filed: Aug. 29, 2019

(65) Prior Publication Data

US 2019/0383289 A1 Dec. 19, 2019

Related U.S. Application Data

(63) Continuation of application No. 15/252,579, filed on Aug. 31, 2016, now Pat. No. 10,400,770.
(Continued)

(51) Int. Cl.
*F01C 17/06* (2006.01)
*F16D 3/04* (2006.01)
(Continued)

(52) U.S. Cl.
CPC ..... *F04C 29/0057* (2013.01); *F01C 17/066* (2013.01); *F04C 18/0215* (2013.01);
(Continued)

(58) Field of Classification Search
CPC ..... F04C 29/0057; F04C 18/0215; F04C 29/0071; F04C 29/02; F01C 17/066; F16D 3/04; F16D 3/70
See application file for complete search history.

(56) References Cited

U.S. PATENT DOCUMENTS 4,121,438 A * 10/1978 McCullough ..... F01C 17/066 464/102
4,877,382 A 10/1989 Caillat et al.
(Continued)

FOREIGN PATENT DOCUMENTS

AU 780605 B2 4/2005
CN 1219647 A 6/1999
(Continued)

OTHER PUBLICATIONS

English translation of JP-2000337272 by Espacenet Sep. 21, 2020.*
(Continued)

*Primary Examiner* — Deming Wan
(74) *Attorney, Agent, or Firm* — Harness, Dickey & Pierce, P.L.C.

(57) ABSTRACT

A compressor may include a non-orbiting scroll, an orbiting scroll, a driveshaft and an Oldham coupling. The orbiting scroll meshingly engages the non-orbiting scroll. The driveshaft includes a crankpin engaging the orbiting scroll and driving the orbiting scroll in an orbital path relative to the non-orbiting scroll. The Oldham coupling may include an annular body and a plurality of first keys extending from the annular body and slidably received in slots formed in the orbiting scroll. Each of the first keys may include a first post and a first cap attached to the first post. The first posts may be integrally formed with the annular body from a first material. The first caps may be formed from a second material.

20 Claims, 12 Drawing Sheets

Related U.S. Application Data

(60) Provisional application No. 62/296,229, filed on Feb. 17, 2016.

(51) Int. Cl.
*F04C 29/00* (2006.01)
*F04C 18/02* (2006.01)
*F04C 29/02* (2006.01)

(52) U.S. Cl.
CPC ..... *F04C 29/0071* (2013.01); *F04C 29/02* (2013.01); *F04C 2210/261* (2013.01); *F04C 2210/266* (2013.01); *F04C 2240/10* (2013.01); *F04C 2240/20* (2013.01); *F04C 2240/40* (2013.01); *F04C 2250/00* (2013.01)

(56) References Cited

U.S. PATENT DOCUMENTS

| | | | |
|---|---|---|---|
| 4,992,033 | A | 2/1991 | Caillat et al. |
| 5,080,566 | A | 1/1992 | Sakata et al. |
| 5,141,417 | A | 8/1992 | Bush |
| 5,141,421 | A | 8/1992 | Bush et al. |
| 5,219,281 | A | 6/1993 | Caillat et al. |
| 5,275,543 | A | 1/1994 | Tanaka et al. |
| 5,320,506 | A | 6/1994 | Fogt |
| 5,330,334 | A | 7/1994 | Bush et al. |
| 5,382,144 | A | 1/1995 | Tanaka et al. |
| 5,403,172 | A | 4/1995 | Blass et al. |
| 5,407,335 | A | 4/1995 | Caillat et al. |
| 5,538,408 | A | 7/1996 | Blass et al. |
| 5,582,512 | A | 12/1996 | Bush |
| 5,704,773 | A | 1/1998 | Higashiyama |
| 5,842,845 | A | 12/1998 | Kawano et al. |
| 5,897,306 | A | 4/1999 | Beck |
| 6,106,252 | A | 8/2000 | Yamanaka et al. |
| 6,139,295 | A | 10/2000 | Utter et al. |
| 6,146,118 | A | 11/2000 | Haller et al. |
| 6,231,324 | B1 | 5/2001 | Clendenin et al. |
| 6,261,072 | B1 | 7/2001 | Abe et al. |
| 6,439,867 | B1 | 8/2002 | Clendenin |
| 6,546,816 | B2 | 4/2003 | Schlabach |
| 6,752,606 | B2 | 6/2004 | Koo |
| 7,014,438 | B2 | 3/2006 | Fukuda et al. |
| 7,182,586 | B2 | 2/2007 | Kim et al. |
| 7,661,938 | B2 | 2/2010 | Ginies et al. |
| 7,717,687 | B2 | 5/2010 | Reinhart |
| 7,736,137 | B2 | 6/2010 | Ueno et al. |
| 7,918,658 | B2 | 4/2011 | Bush et al. |
| 8,057,202 | B2 | 11/2011 | Haller |
| 8,096,792 | B2 | 1/2012 | Suefuji et al. |
| 8,157,550 | B2 | 4/2012 | Kudo |
| 8,177,534 | B2 | 5/2012 | Ni |
| 8,186,980 | B2 | 5/2012 | Komai et al. |
| 8,241,022 | B2 | 8/2012 | Nakajima |
| 8,262,377 | B2 | 9/2012 | Caillat et al. |
| 8,287,257 | B2 | 10/2012 | Dunaevsky |
| 8,303,280 | B2 | 11/2012 | Kiyokawa et al. |
| 8,356,987 | B2 | 1/2013 | Guo et al. |
| 8,393,882 | B2 | 3/2013 | Ignatiev et al. |
| 8,651,842 | B2 | 2/2014 | Yamamoto et al. |
| 8,864,479 | B2 | 10/2014 | Watts et al. |
| 8,931,759 | B2 | 1/2015 | Bonanno et al. |
| 8,967,986 | B2 | 3/2015 | Harashima et al. |
| 9,017,050 | B2 | 4/2015 | Ginies et al. |
| 9,181,949 | B2 | 11/2015 | Duppert et al. |
| 9,316,223 | B2 | 4/2016 | Unami et al. |
| 9,322,404 | B2 | 4/2016 | Roof et al. |
| 9,347,441 | B2 | 5/2016 | Rice et al. |
| 10,400,770 | B2 | 9/2019 | Fullenkamp et al. |
| 2008/0085204 | A1 | 4/2008 | Lifson |
| 2008/0119294 | A1 | 5/2008 | Erikson et al. |
| 2009/0317276 | A1 | 12/2009 | Lee et al. |
| 2011/0044833 | A1 | 2/2011 | Dunaevsky |
| 2014/0178228 | A1 | 6/2014 | Rosson et al. |
| 2014/0369819 | A1 | 12/2014 | Yamashita et al. |
| 2015/0037190 | A1 | 2/2015 | Smerud et al. |
| 2015/0260189 | A1 | 9/2015 | Kato |
| 2016/0115954 | A1 | 4/2016 | Doepker et al. |
| 2016/0123326 | A1 | 5/2016 | Fogt et al. |
| 2016/0230764 | A1 | 8/2016 | Tatsuwaki et al. |
| 2016/0238006 | A1 | 8/2016 | Rosson et al. |
| 2017/0067466 | A1 | 3/2017 | Oh et al. |
| 2020/0208632 | A1 | 7/2020 | Nagulpelli et al. |

FOREIGN PATENT DOCUMENTS

| | | | | |
|---|---|---|---|---|
| CN | 1515799 | A | 7/2004 | |
| CN | 206668549 | U | 11/2017 | |
| JP | S6388288 | A | 1/1988 | |
| JP | H02227581 | A | 9/1990 | |
| JP | H04330392 | A | 11/1992 | |
| JP | H0587063 | A | 4/1993 | |
| JP | H05223068 | A | 8/1993 | |
| JP | H0610853 | A | 1/1994 | |
| JP | H0688579 | A | 3/1994 | |
| JP | 2000337272 | A | * 12/2000 | ..... F01C 17/066 |
| KR | 20170029313 | A | 3/2017 | |

OTHER PUBLICATIONS

U.S. Appl. No. 16/404,124, filed May 6, 2019, Vinayak N. Nagulpelli et al.

Search Report regarding European Patent Application No. 17156102.0, dated Jul. 24, 2017.

Office Action regarding Chinese Patent Application No. 201710083894.9, dated Jun. 4, 2018. Translation provided by Unitalen Attorneys at Law.

Office Action regarding U.S. Appl. No. 15/252,579, dated Jun. 26, 2018.

Office Action regarding U.S. Appl. No. 15/252,579, dated Dec. 20, 2018.

Office Action regarding Chinese Patent Application No. 201710083894.9, dated Feb. 27, 2019. Translation provided by Unitalen Attorneys at Law.

Notice of Allowance regarding U.S. Appl. No. 15/252,579, dated Jun. 20, 2019.

Office Action regarding Chinese Patent Application No. 201710083894.9, dated Aug. 27, 2019. Translation provided by Unitalen Attorneys at Law.

Office Action regarding European Patent Application No. 17156102.0, dated Feb. 26, 2020.

Office Action regarding Indian Patent Application No. 201821049934, dated Aug. 10, 2020.

* cited by examiner

COMPRESSOR WITH OLDHAM ASSEMBLY

CROSS-REFERENCE TO RELATED APPLICATIONS

This application is a continuation of U.S. patent application Ser. No. 15/252,579 filed on Aug. 31, 2016, which claims the benefit of U.S. Provisional Application No. 62/296,229 filed on Feb. 17, 2016. The entire disclosures of the above applications are incorporated herein by reference.

FIELD

The present disclosure relates to a compressor with an Oldham assembly.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., refrigerant or carbon dioxide) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure, and is not a comprehensive disclosure of its full scope or all of its features.

The present disclosure provides a compressor including a non-orbiting scroll, an orbiting scroll, a driveshaft and an Oldham coupling. The orbiting scroll meshingly engages the non-orbiting scroll. The driveshaft includes a crankpin engaging the orbiting scroll and driving the orbiting scroll in an orbital path relative to the non-orbiting scroll. The Oldham coupling may include an annular body and a plurality of first keys (e.g., protrusions) extending from the annular body and slidably received in slots formed in the orbiting scroll. Each of the first keys may include a first post and a first cap (or insert) covering at least a portion of the first post. The first posts may be integrally formed with the annular body from a first material. The first caps may be attached to the first posts and formed from a second material (i.e., a material that is different from the first material).

In some configurations, the Oldham coupling includes a plurality of second keys (e.g., protrusions) extending from the annular body. Each of the second keys may include a second post and a second cap covering at least a portion of the second post. The second posts may be integrally formed with the annular body from the first material. The second caps may be attached to the second posts and formed from the second material.

In some configurations, the second keys slidably engage slots formed in the non-orbiting scroll.

In some configurations, the second keys slidably engage slots formed in a main bearing housing that axially supports the orbiting scroll.

In some configurations, the first and second caps are all discrete components that are non-integrally formed.

In some configurations, each of the first and second caps includes an aperture into which a corresponding one of the first and second posts extends.

In some configurations, the apertures extend entirely through the caps.

In some configurations, the first and second posts extend entirely through the corresponding apertures.

In some configurations, the apertures extend only partially through the caps.

In some configurations, the first and second caps are H-shaped, and each of the first and second posts includes a slot receiving a portion of a corresponding one of the first and second caps.

In some configurations, each of the first and second caps includes a pair of slots receiving portions of a corresponding one of the first and second posts.

In some configurations, the first caps are fixed to the first posts by press fit.

In some configurations, the first caps are threadably attached to the first posts.

In some configurations, the first caps are attached to the first posts by roll pins.

In some configurations, a portion of each of the first caps is embedded in a corresponding one of the first posts.

In some configurations, the first posts are cast around portions of the first caps.

In some configurations, each of the first caps includes a plurality of protrusions embedded in a corresponding one of the first posts.

In some configurations, the first material is a metal and the second material includes a polymer.

In some configurations, the second material includes a metal.

In some configurations, the first material is a first metal and the second material includes a second metal.

In some configurations, the first material and the second material are both exposed to fluid (e.g., working fluid, oil, etc.) within a shell of the compressor.

In some configurations, the caps are formed entirely from the second material, rather than just being coated with the second material.

In some configurations, the first caps are fixed to the first posts by snap fit.

In some configurations, each of the first posts includes a main body having a first width and a flanged portion disposed at a distal end of the main body, the flanged portion having a second width that is greater than the first width. The first and second widths are measured in the same direction.

In some configurations, each of the first caps includes an aperture and a recess disposed at an end of the aperture, the aperture receiving the main body and the recess receiving the flanged portion, wherein the aperture includes a third width that is measured in the same direction as the first and second widths.

In some configurations, each of the first posts includes a groove that partially defines the flanged portion.

In some configurations, the first caps are fixed to the first posts by deformations formed on the first posts.

In some configurations, each of the first caps includes an aperture and a pair of grooves, the aperture receiving a corresponding one of the first posts, the grooves receiving the deformations formed on the first posts.

In some configurations, the grooves are open to the aperture and extend through a distal end of the first cap.

In another form, the present disclosure provides a compressor that includes a non-orbiting scroll, an orbiting scroll, a driveshaft and an Oldham coupling. The orbiting scroll meshingly engages the non-orbiting scroll. The driveshaft includes a crankpin engaging the orbiting scroll and driving the orbiting scroll in an orbital path relative to the non-orbiting scroll. The Oldham coupling may include an annular body and a plurality of keys extending from the annular body. At least some of the keys may be slidably received in slots formed in the orbiting scroll. The annular body may be formed from a first material. The keys may be attached to the annular body and may include caps formed from a second material (i.e., a material that is different from the first material).

In some configurations, the caps are all discrete components that are non-integrally formed.

In some configurations, each of the caps includes an aperture into which a corresponding post extends. The posts may be integrally formed with the body.

In some configurations, the apertures extend entirely through the caps.

In some configurations, the posts extend entirely through the corresponding apertures.

In some configurations, the apertures extend only partially through the caps.

In some configurations, the body includes a plurality of integrally formed posts. The caps may be H-shaped. Each of the posts may include a slot receiving a portion of a corresponding one of the caps.

In some configurations, each of the caps includes a pair of slots receiving portions of a corresponding one of the posts.

In some configurations, the caps are fixed relative to the body by press fit.

In some configurations, the caps are threadably attached to the body.

In some configurations, the caps are attached to the body by roll pins.

In some configurations, a portion of each of the caps is embedded in the body.

In some configurations, the body is cast around portions of the caps.

In some configurations, each of the caps includes a plurality of protrusions embedded in the body.

In some configurations, the first material is a metal and the second material includes a polymer.

In some configurations, the second material includes a metal.

In some configurations, the first material is a first metal and the second material includes a second metal.

In some configurations, the first material and the second material are both exposed to fluid within a shell of the compressor.

In some configurations, the keys are formed entirely from the second material.

In some configurations, the caps are attached to the body by an adhesive.

In some configurations, the caps are attached to the body by swaging.

In some configurations, the keys include posts integrally formed with the annular body, and the caps are fixed to the posts by snap fit.

In some configurations, each of the posts includes a main body having a first width and a flanged portion disposed at a distal end of the main body, the flanged portion having a second width that is greater than the first width. The first and second widths are measured in the same direction.

In some configurations, each of the caps includes an aperture and a recess disposed at an end of the aperture, the aperture receiving the main body and the recess receiving the flanged portion, wherein the aperture includes a third width that is measured in the same direction as the first and second widths.

In some configurations, each of the posts includes a groove that partially defines the flanged portion.

In some configurations, the keys include posts integrally formed with the annular body, and wherein the caps are fixed to the posts by deformations formed on the posts.

In some configurations, each of the caps includes an aperture and a pair of grooves, the aperture receiving a corresponding one of the posts, the grooves receiving the deformations formed on the posts.

In some configurations, the grooves are open to the aperture and extend through a distal end of the cap.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
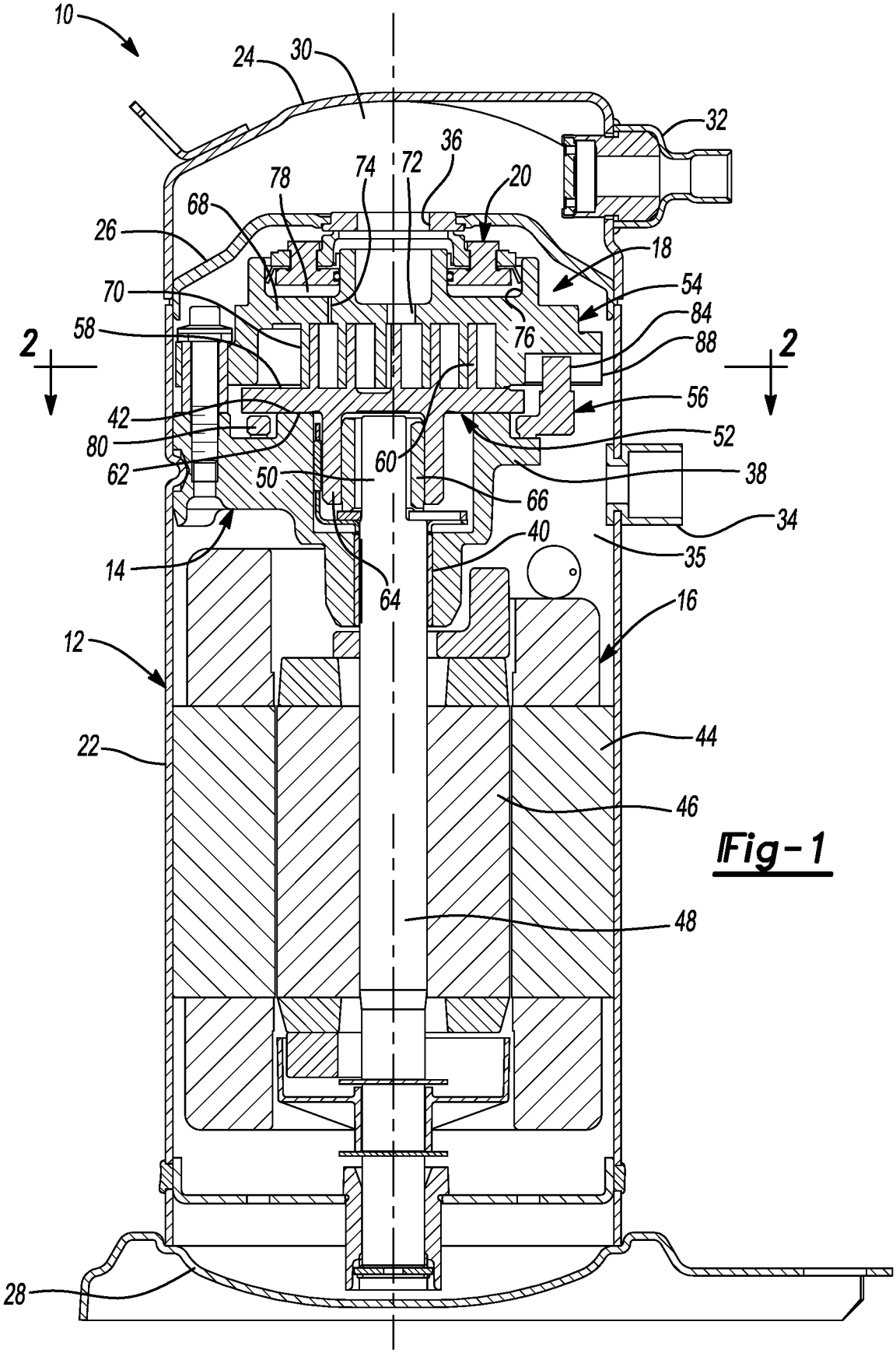
FIG. 1 is a cross-sectional view of a compressor having an Oldham coupling according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a compressor 10 is provided that may include a hermetic shell assembly 12, a bearing housing assembly 14, a motor assembly 16, a compression mechanism 18, and a seal assembly 20. The shell assembly 12 may generally form a compressor housing and may include a cylindrical shell 22, an end cap 24 at the upper end thereof, a transversely extending partition 26, and a base 28 at a lower end thereof. The end cap 24 and partition 26 may generally define a discharge chamber 30. A discharge fitting 32 may be attached to the shell assembly 12 at an opening in the end cap 24. A suction gas inlet fitting 34 may be attached to the shell assembly 12 at another opening and may communicate with a suction chamber 35 defined by the shell 22 and the partition 26. The partition 26 may include a discharge passage 36 therethrough providing communication between the compression mechanism 18 and the discharge chamber 30.

The bearing housing assembly 14 may be affixed to the shell 22 and may include a main bearing housing 38 and a bearing 40. The main bearing housing 38 may house the bearing 40 therein and may define an annular flat thrust bearing surface 42 on an axial end surface thereof.

The motor assembly 16 may include a motor stator 44, a rotor 46, and a driveshaft 48. The motor stator 44 may be press fit into the shell 22. The driveshaft 48 may be rotatably driven by the rotor 46 and may be rotatably supported within the bearing 40. The rotor 46 may be press fit on the driveshaft 48. The driveshaft 48 may include an eccentric crankpin 50.

The compression mechanism 18 may generally include an orbiting scroll 52, a non-orbiting scroll 54 and an Oldham coupling 56. The orbiting scroll 52 may include an end plate 58 having a spiral wrap 60 on the upper surface thereof and an annular flat thrust surface 62 on the lower surface. The thrust surface 62 may interface with the annular flat thrust bearing surface 42 on the main bearing housing 38. A cylindrical hub 64 may project downwardly from the thrust surface 62 and may have a drive bushing 66 rotatably disposed therein. The drive bushing 66 may include an inner bore in which the crank pin 50 is drivingly disposed. A flat surface of the crankpin 50 may drivingly engage a flat surface in a portion of the inner bore of the drive bushing 66 to provide a radially compliant driving arrangement. The Oldham coupling 56 may be engaged with the orbiting and non-orbiting scrolls 52, 54 or with the orbiting scroll 52 and the main bearing housing 38 to prevent relative rotation therebetween.

The non-orbiting scroll 54 may include an end plate 68 and a spiral wrap 70 projecting downwardly from the end plate 68. The spiral wrap 70 may meshingly engage the spiral wrap 60 of the orbiting scroll 52, thereby creating a series of moving fluid pockets. The fluid pockets defined by the spiral wraps 60, 70 may decrease in volume as they move from a radially outer position (at a suction pressure) to a radially intermediate position (at an intermediate pressure) to a radially inner position (at a discharge pressure) throughout a compression cycle of the compression mechanism 18.

The end plate 68 may include a discharge passage 72, an intermediate passage 74, and an annular recess 76. The discharge passage 72 is in communication with one of the fluid pockets at the radially inner position and allows compressed working fluid (e.g., at the discharge pressure) to flow into the discharge chamber 30. The intermediate passage 74 may provide communication between one of the fluid pockets at the radially intermediate position and the annular recess 76. The annular recess 76 may receive the seal assembly 20 and cooperate with the seal assembly 20 to define an axial biasing chamber 78 therebetween. The biasing chamber 78 receives fluid from the fluid pocket in the intermediate position through the intermediate passage 74. A pressure differential between the intermediate-pressure fluid in the biasing chamber 78 and fluid in the suction chamber 35 exerts an axial biasing force on the non-orbiting scroll 54 urging the non-orbiting scroll 54 toward the orbiting scroll 52 to sealingly engage the scrolls 52, 54 with each other.

Figure 2:
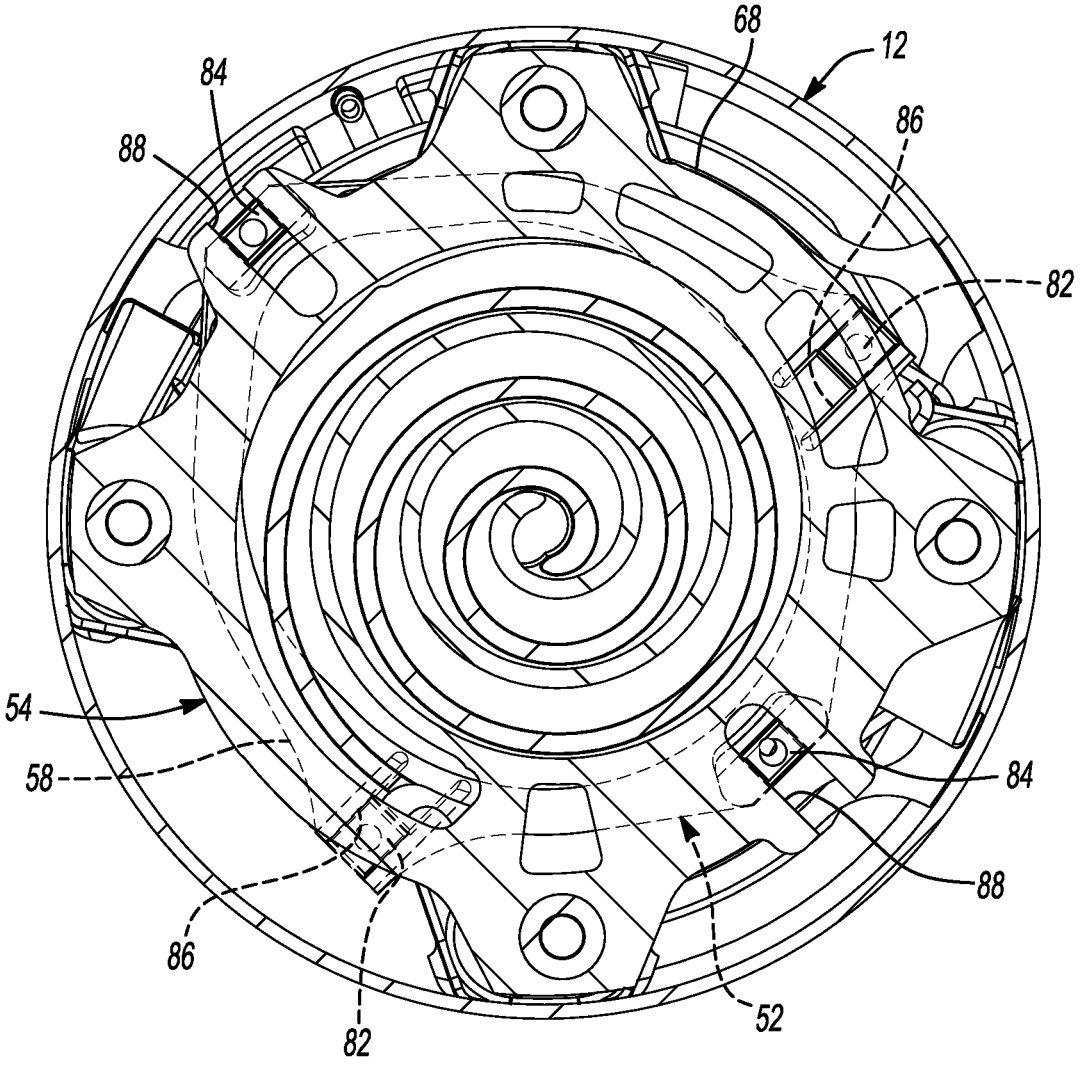
FIG. 2 is a cross-sectional view of the compressor taken along line 2-2 of FIG. 1.
Figure 3:
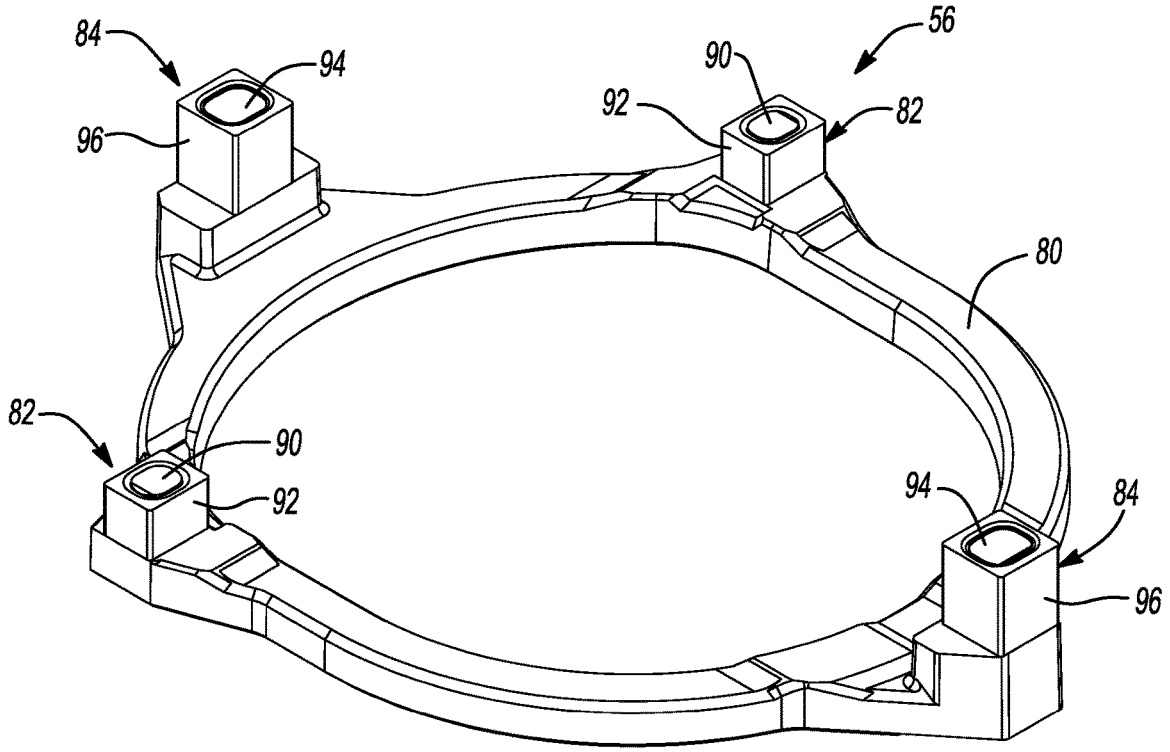
FIG. 3 is a perspective view of the Oldham coupling of the compressor of FIG. 1.
Figure 4:
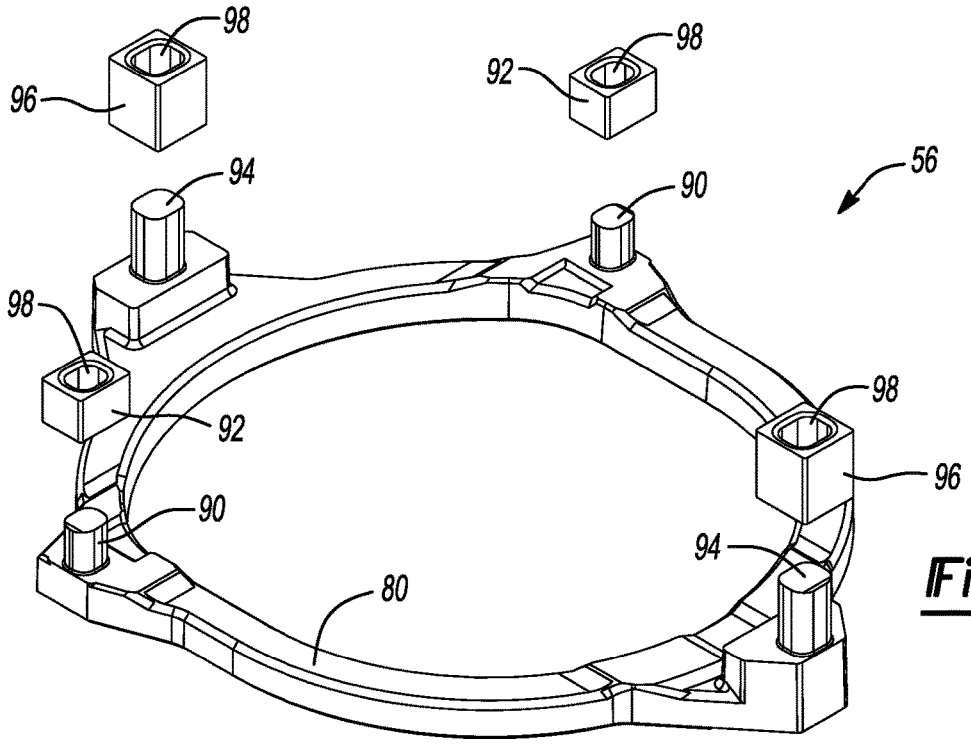
FIG. 4 is an exploded perspective view of the Oldham coupling of FIG. 3.

As shown in FIGS. 3 and 4, the Oldham coupling 56 may be a generally ring-shaped member having an annular body 80, a plurality of first keys 82 and a plurality of second keys 84. As shown in FIG. 1, the body 80 may be supported by the main bearing housing 38 to allow the body 80 to be slidably movable thereon. The first and second keys 82, 84 may extend from the body 80 in an axial direction (i.e., in a direction parallel to a rotational axis of the driveshaft 48). As shown in FIG. 2, the first keys 82 may slidably engage slots (keyways) 86 formed in the end plate 58 of the orbiting scroll 52, and the second keys 84 may slidably engage slots (keyways) 88 formed in the end plate 68 of the non-orbiting scroll 54. In this manner, the Oldham coupling 56 prevents rotation of the orbiting scroll 52 relative to the non-orbiting scroll 54 while allowing orbital movement of the orbiting scroll 52 relative to the non-orbiting scroll 54.

While the first and second keys 82, 84 are shown in the figures extending in the same direction from the body 80 (i.e., axially upward from the body 80), in some configurations, the first keys 82 may extend away from the body 80 in a direction opposite a direction from which the second keys 84 extend away from the body 80. Further, in some configurations, the second keys 84 may slidably engage slots formed in the main bearing housing 38 instead of the slots 88 in the non-orbiting scroll 54.

As shown in FIGS. 3 and 4, each of the first keys 82 may include a post 90 and a cap (or insert) 92, and each of the second keys 84 may include a post 94 and a cap (or insert) 96. The posts 90, 94 may be integrally formed with the body 80 from a first material (e.g., aluminum, iron, steel or another metal or composite). For example, the body 80 and posts 90, 94 can be cast as a single, unitary body and/or machined from a single, unitary piece of material.

The caps 92, 96 may be discrete components formed from a second material (i.e., a material that is different from the first material) and attached to the posts 90, 94. In some configurations, the caps 92, 96 may be made entirely from the second material, rather than just being coated with the second material. The second material can be or include Vesper) (i.e., polymide containing graphite; manufactured by DuPont), bronze (e.g., bismuth bronze, bronze with graphite, bronze with silicone, etc.), aluminum bronze, cast iron, ceramic, polyarletherketone (PAEK) group materials (e.g., resins including polyetheretherketone (PEEK), polyetherketone (PEK), polyetheretheretherketone (PEEEK), polyetherketoneketone (PEKK), polyetheretherketoneketone (PEEKK), polyetherketoneetheretherketone (PEKEEK), polyetheretherketoneetheretherketone (PEEKEEK), or combinations thereof), polyamideimide (PAI) (e.g., Torlon®, manufactured by Solvay), polyphenylene sulfide (PPS), or polyphthalamide (PPA), for example, or other materials with high lubricity.

Each of the caps 92, 96 may include an aperture 98 that extends entirely through the cap 92, 96 and receives a corresponding one of the posts 90, 94. The posts 90, 94 may extend entirely through the apertures 98 or only partially through the apertures 98. The posts 90, 94 can be press-fit into the apertures 98, adhesively bonded therein, secured with fasteners and/or otherwise securely attached.

With the caps 92, 96 attached to the posts 90, 94, the keys 82, 84 are less susceptible to wear as a result of friction between the keys 82, 84 and the walls of the slots 86, 88. That is, the caps 92, 96 may isolate the posts 90, 94 from some or all of the friction between the keys 82, 84 and the walls of the slots 86, 88. Further, because the caps 92, 96 may be formed from a material or materials having a high lubricity and/or less prone to wear, the caps 92, 96 can extend the life of the Oldham coupling 56 and present damage to the Oldham coupling 56. This structure of the keys 82, 84 may be particularly beneficial in compressors having certain working fluids or refrigerants, such as propane (e.g., R290) and carbon dioxide, for example. Such working fluids can cause excessive wear on keys of conventional Oldham couplings because such working fluids have a tendency to reduce the effectiveness of lubricants (e.g., oil) in the compressor. It will be appreciated, however, that structure of the keys 82, 84 may be beneficial in reducing wear and improving performance in compressors having any type of refrigerant or working fluid.

In some configurations, inserts (not shown) formed from the second material could be fixedly received in the slots 86, 88. The inserts could include slots (keyways) that slidably receive the keys 82, 84, thereby further reducing friction due to the sliding engagement between the keys 82, 84 and the scrolls 52, 54.

Figure 5:
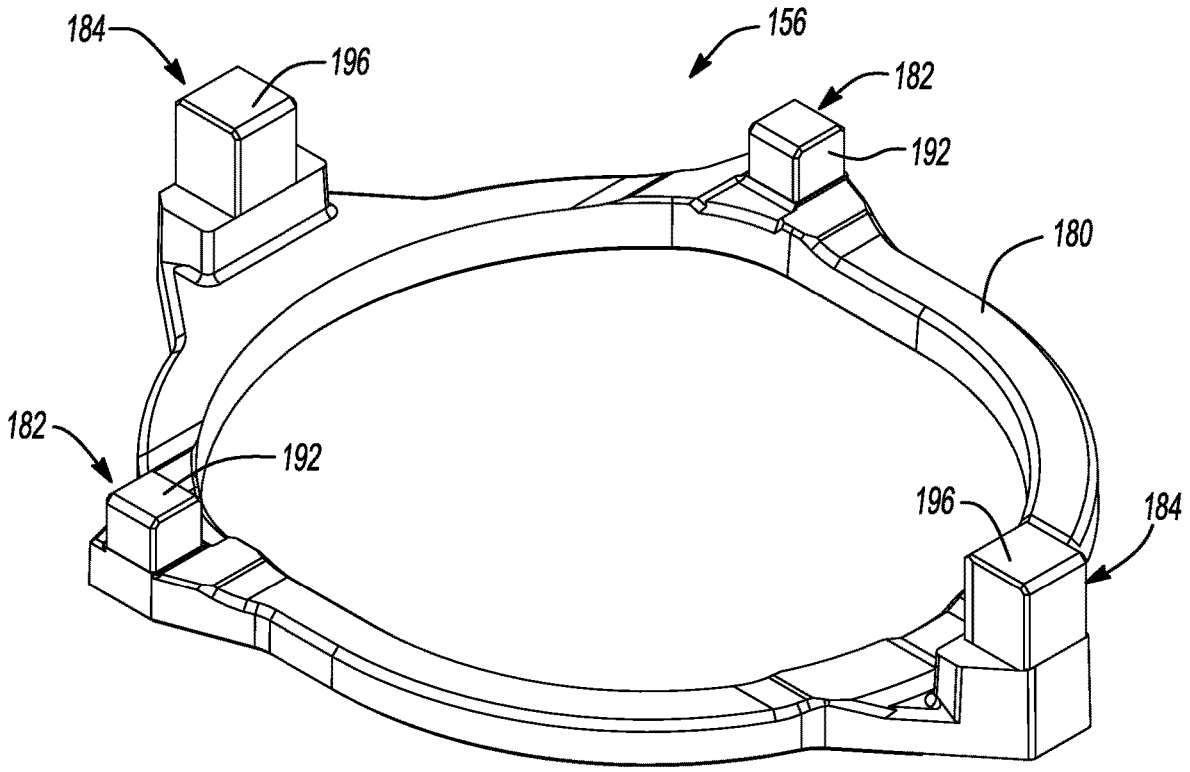
FIG. 5 is a perspective view of another Oldham coupling according to the principles of the present disclosure.
Figure 6:
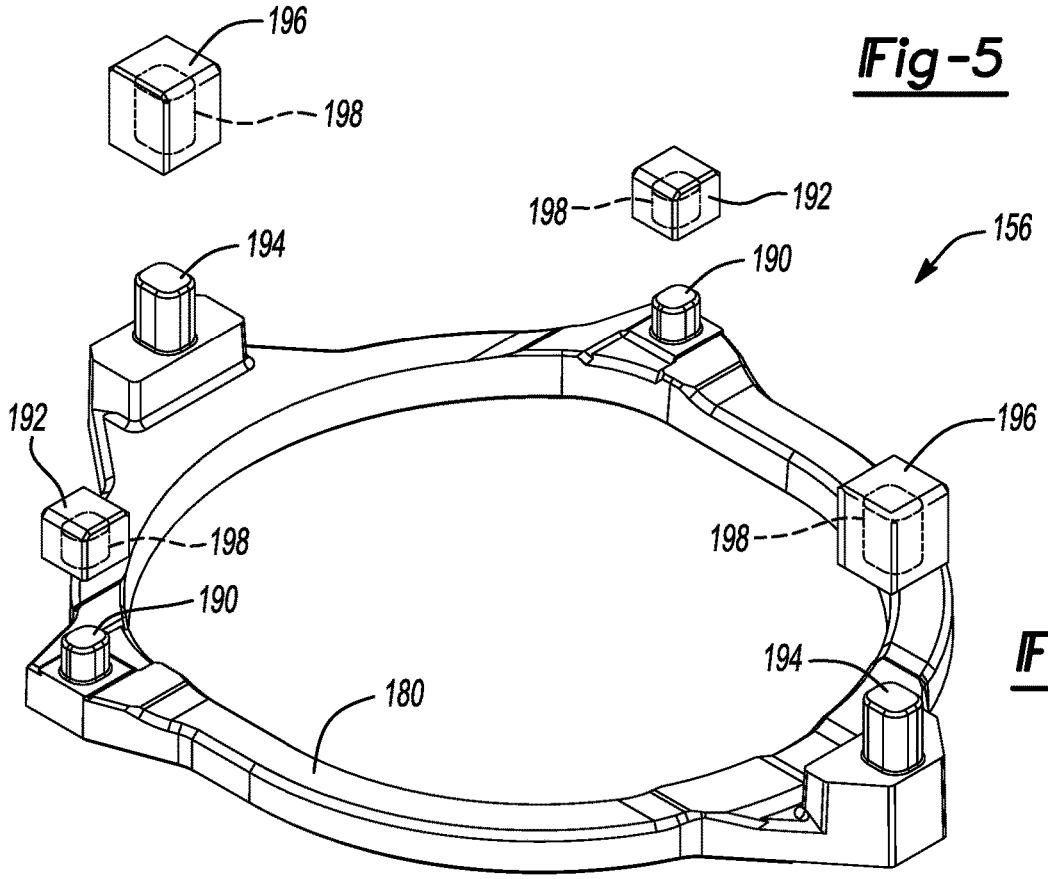
FIG. 6 is an exploded perspective view of the Oldham coupling of FIG. 5.

Referring now to FIGS. 5 and 6, another Oldham coupling 156 is provided that can be incorporated into the compressor 10 instead of the Oldham coupling 56. The structure and function of the Oldham coupling 156 can be similar or identical to that of the Oldham coupling 56, apart from the differences described below and/or shown in the figures.

As described above with respect to the Oldham coupling 56, the Oldham coupling 156 may include a generally annular body 180, a plurality of first keys 182 and a plurality of second keys 184. Like the keys 82, 84, the keys 182, 184 may include posts 190, 194 and caps 192, 196. The posts 190, 194 and body 180 may be formed from a first material, and the caps 192, 196 may be formed from a second material, as described above. The caps 192, 196 may include apertures 198 extending partially therethrough and receiving the posts 190, 194. In this manner, the posts 190, 194 may be completely contained within the apertures 198. The posts 190, 194 can be press-fit into the apertures 198, adhesively bonded therein, secured with fasteners and/or otherwise securely attached.

Figure 7:
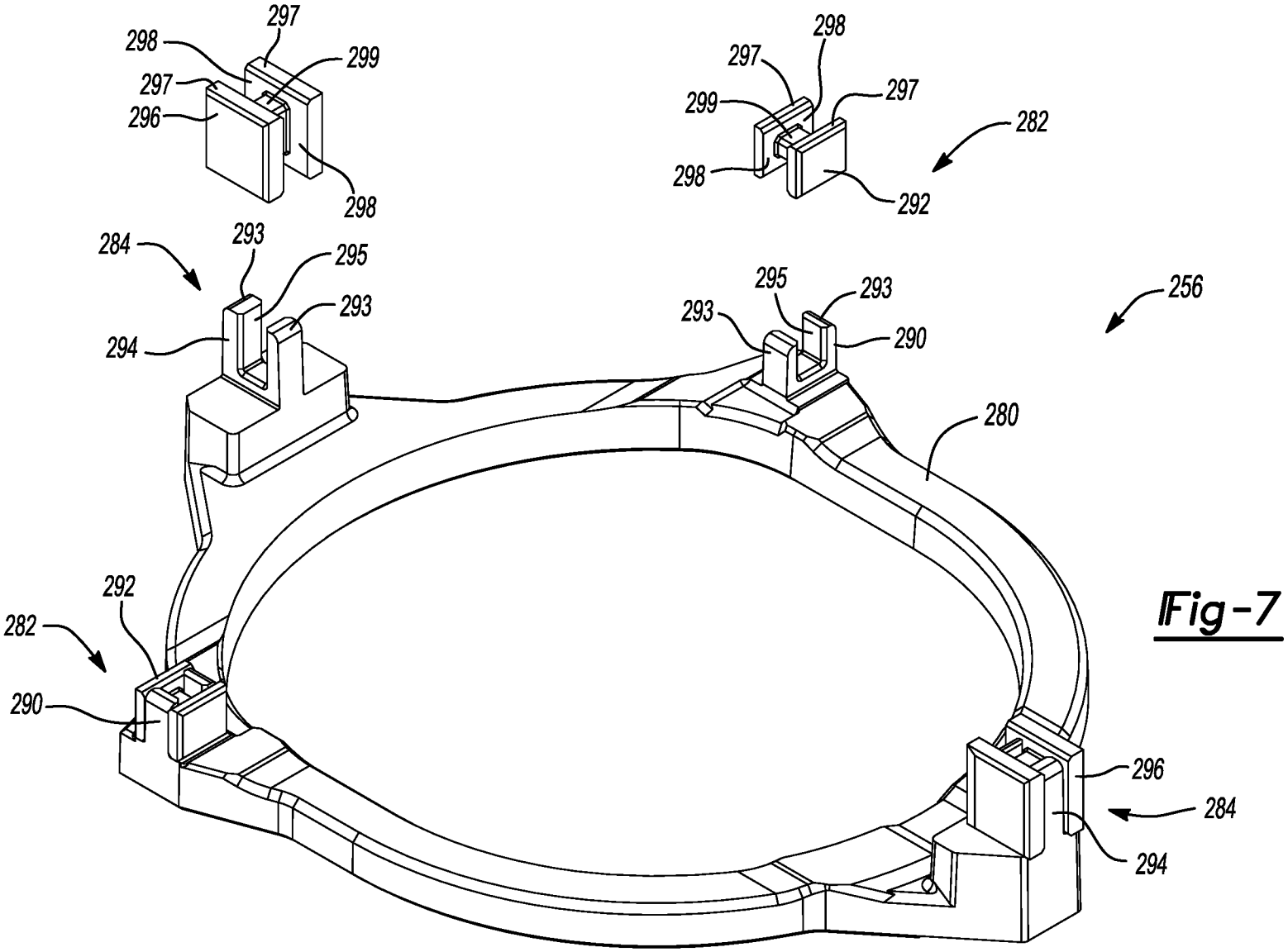
FIG. 7 is a partially exploded perspective view of another Oldham coupling according to the principles of the present disclosure.
Figure 8:
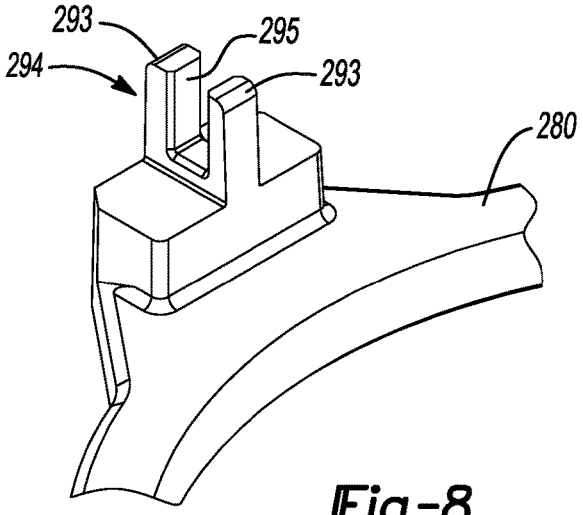
FIG. 8 is a perspective view of a portion of the Oldham coupling of FIG. 7.
Figure 9:
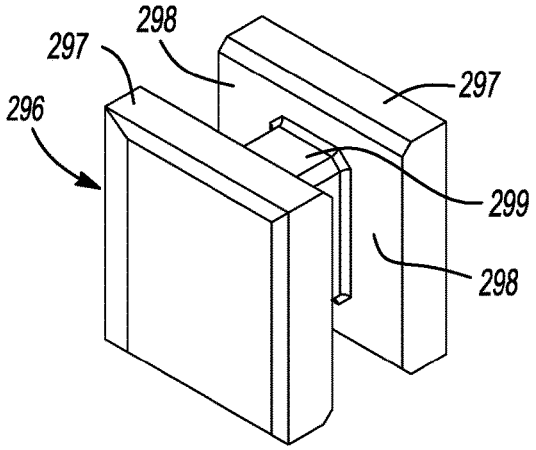
FIG. 9 is a perspective view of a cap of the Oldham coupling of FIG. 7.

Referring now to FIGS. 7-9, another Oldham coupling 256 is provided that can be incorporated into the compressor 10 instead of the Oldham coupling 56. The structure and function of the Oldham coupling 256 can be similar or identical to that of the Oldham coupling 56, apart from the differences described below and/or shown in the figures.

As described above with respect to the Oldham coupling 56, the Oldham coupling 256 may include a generally annular body 280, a plurality of first keys 282 and a plurality of second keys 284. The keys 282, 284 may include posts 290, 294 and caps 292, 296. The posts 290, 294 and body 280 may be formed from a first material, and the caps 292, 296 may be formed from a second material, as described above.

As shown in FIGS. 7 and 8, each of the posts 290, 294 may include a pair of protrusions 293 defining a channel or slot 295 therebetween such that the posts 290, 294 have a generally U-shaped profile. As shown in FIGS. 7 and 9, the caps 292, 296 may be generally H-shaped members having a pair of blocks 297 and a cross-member 299 extending between and interconnecting the blocks 297. The cross-member 299 and blocks 297 form a pair of channels or slots 298. When the caps 292, 296 are assembled onto the posts 290, 294, the protrusions 293 of the posts 290, 294 are received into corresponding slots 298 of the caps 292, 296, and the cross-members 299 of the caps 292, 296 are received into the slots 295 of the posts 290, 294. In this manner, the caps 292, 296 can be press-fit into engagement with the posts 290, 294, adhesively bonded and/or otherwise fixedly secured. As shown in FIG. 7, distal edges of the caps 292, 296 may protrude further from the body 280 that the distal edges of the posts 290, 294 such that the posts 290, 294 are shielded from friction with the scrolls 52, 54.

Figure 10:
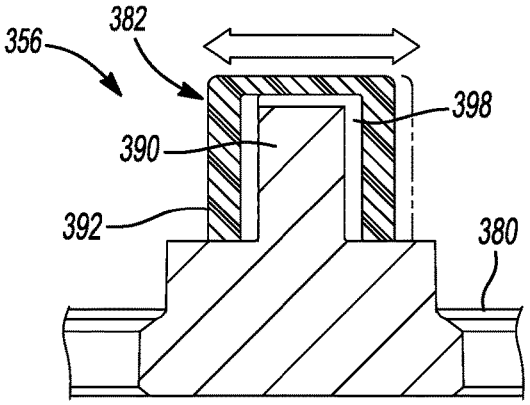
FIG. 10 is a partial cross-sectional view of another Oldham coupling according to the principles of the present disclosure.

Referring now to FIG. 10, another Oldham coupling 356 (only partially shown in FIG. 10) is provided that can be incorporated into the compressor 10 instead of the Oldham coupling 56. The structure and function of the Oldham coupling 356 can be similar or identical to that of the Oldham coupling 56, apart from the differences described below and/or shown in the figures.

As described above with respect to the Oldham coupling 56, the Oldham coupling 356 may include a generally annular body 380 and a plurality of keys 382. The keys 382 may include posts 390 and caps 392. The posts 390 and body 380 may be formed from a first material, and the caps 392 may be formed from a second material, as described above. The caps 392 may include apertures 398 that extend partially or entirely therethrough and receive the posts 390. The apertures 398 may be sufficiently larger in size than the posts 390 to allow the caps 392 to move radially (i.e., in directions perpendicular to the rotational axis of the driveshaft 48) relative to the posts 390 when the posts 390 are received within the apertures 398. Adhesive and/or other fasteners could be used to attach the posts 390 to the caps 392.

Figure 11:
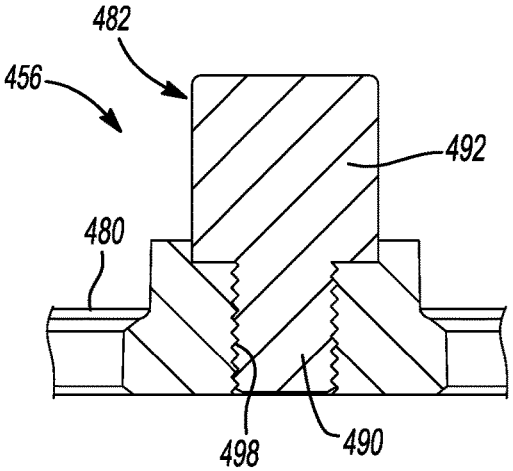
FIG. 11 is a partial cross-sectional view of another Oldham coupling according to the principles of the present disclosure.

Referring now to FIG. 11, another Oldham coupling 456 (only partially shown in FIG. 11) is provided that can be incorporated into the compressor 10 instead of the Oldham coupling 56. The structure and function of the Oldham coupling 456 can be similar or identical to that of the Oldham coupling 56, apart from the differences described below and/or shown in the figures.

As described above with respect to the Oldham coupling 56, the Oldham coupling 456 may include a generally annular body 480 and a plurality of keys 482. The keys 482 may include posts 490 and caps 492. Each post 490 may be integrally formed with a corresponding one of the caps 492 and may threadably engage apertures 498 formed in the body 480. The body 480 may be formed from a first material, and the posts 490 and caps 492 may be formed from a second material.

Figure 12:
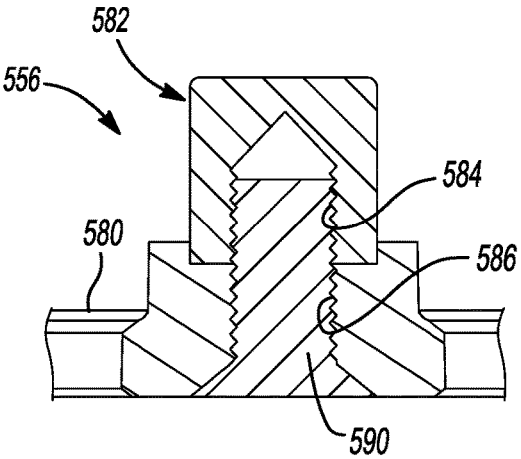
FIG. 12 is a partial cross-sectional view of another Oldham coupling according to the principles of the present disclosure.

Referring now to FIG. 12, another Oldham coupling 556 (only partially shown in FIG. 12) is provided that can be incorporated into the compressor 10 instead of the Oldham coupling 56. The structure and function of the Oldham coupling 556 can be similar or identical to that of the Oldham coupling 56, apart from the differences described below and/or shown in the figures.

As described above with respect to the Oldham coupling 56, the Oldham coupling 556 may include a generally annular body 580 and a plurality of keys (caps) 582. The keys 582 may include threaded apertures 584 that are aligned with apertures 586 in the body 580. Threaded fasteners 590 may extend through corresponding apertures 586 in the body 580 and threadably engage corresponding apertures 584 in the keys 582. The body 580 may be formed from a first material, and the keys 582 may be formed from a second material.

Figure 13:
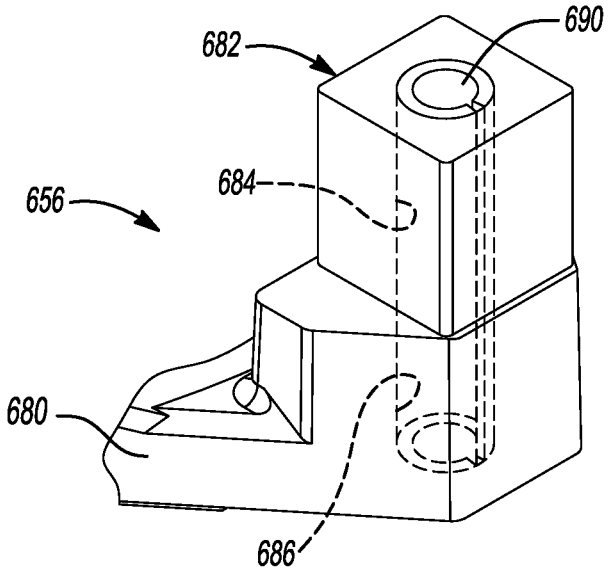
FIG. 13 is a partial cross-sectional view of another Oldham coupling according to the principles of the present disclosure.

Referring now to FIG. 13, another Oldham coupling 656 (only partially shown in FIG. 13) is provided that can be incorporated into the compressor 10 instead of the Oldham coupling 56. The structure and function of the Oldham coupling 656 can be similar or identical to that of the Oldham coupling 56, apart from the differences described below and/or shown in the figures.

As described above with respect to the Oldham coupling 56, the Oldham coupling 656 may include a generally annular body 680 and a plurality of keys (caps) 682. The keys 682 may include apertures 684 that are aligned with apertures 686 in the body 680. Roll pins 690 may be pressed into corresponding apertures 686, 684 such that the diameters of the pins 690 are compressed when received in the apertures 686, 684, thereby fixedly securing the keys 682 to the body 680. The body 680 may be formed from a first material, and the keys 682 may be formed from a second material.

Figure 14:
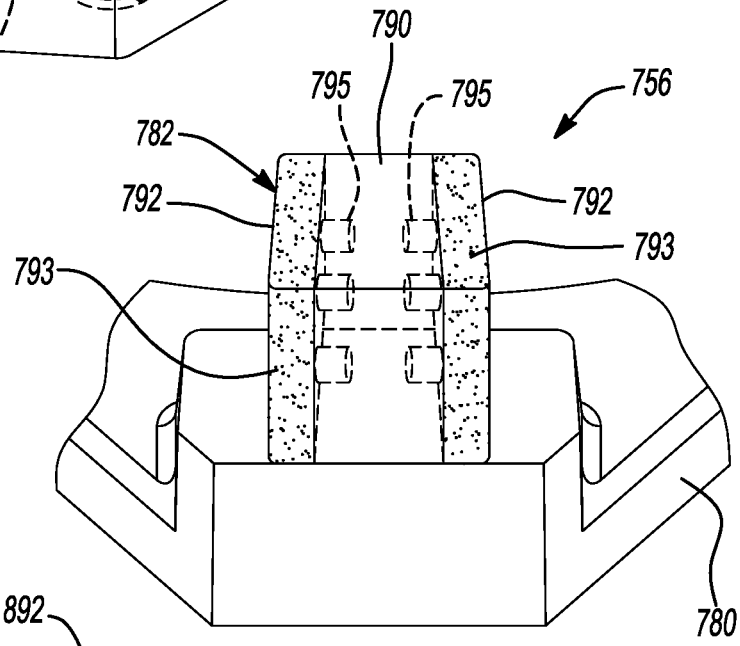
FIG. 14 is a partial cross-sectional view of another Oldham coupling according to the principles of the present disclosure.

Referring now to FIG. 14, another Oldham coupling 756 (only partially shown in FIG. 14) is provided that can be incorporated into the compressor 10 instead of the Oldham coupling 56. The structure and function of the Oldham coupling 756 can be similar or identical to that of the Oldham coupling 56, apart from the differences described below and/or shown in the figures.

As described above with respect to the Oldham coupling 56, the Oldham coupling 756 may include a generally annular body 780 and a plurality of keys 782. Each of the keys 782 may include a post 790 and a pair of caps 792. The posts 790 may be integrally formed with the body 780 from a first material.

The caps 792 may be formed from a second material and may each include a main body 793 (e.g., a rectangular block) and a plurality of protrusions 795 (e.g., cylindrical or rectangular protrusions) extending from the main body 793. Each post 790 may be sandwiched between two caps 792.

The protrusions 795 of each cap 792 may be embedded in a corresponding post 790. In some configurations, the posts 790 and body 780 may be cast with the caps 792 placed in the casting mold such that the posts 790 are cast around the protrusions 795 (so as to embed the protrusions 795 inside of the posts 790). In this manner, the caps 792 are fixedly secured to the posts 790.

It will be appreciated that the protrusions 795 can be arranged on the main body 793 of the cap 792 in any suitable manner. For example, the protrusions 795 on each cap 792 can be arranged in a linear pattern, a staggered pattern, or in a triangular pattern.

Figure 15:
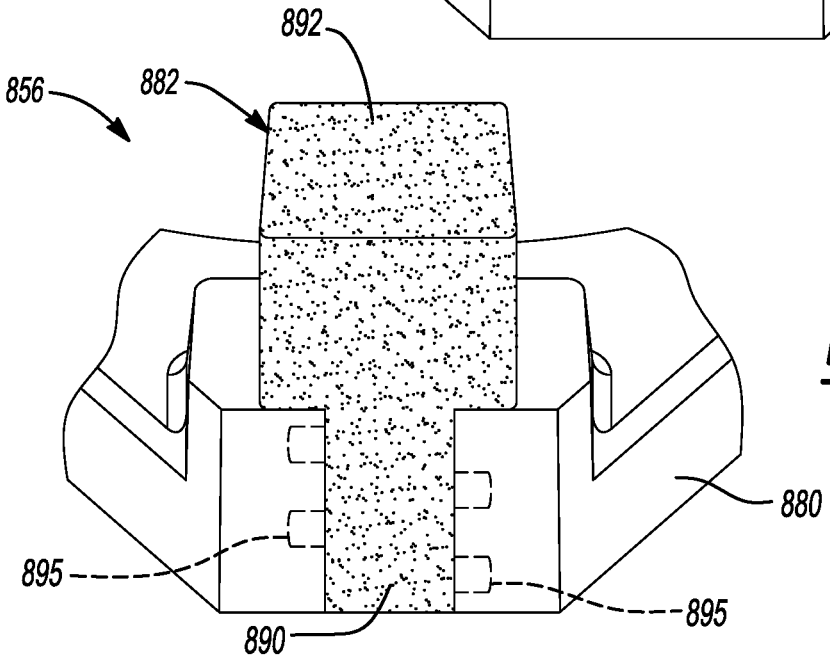
FIG. 15 is a partial cross-sectional view of another Oldham coupling according to the principles of the present disclosure.

Referring now to FIG. 15, another Oldham coupling 856 (only partially shown in FIG. 15) is provided that can be incorporated into the compressor 10 instead of the Oldham coupling 56. The structure and function of the Oldham coupling 856 can be similar or identical to that of the Oldham coupling 756, apart from the differences described below and/or shown in the figures.

As described above, the Oldham coupling 856 may include a generally annular body 880 and a plurality of keys 882. Each of the keys 882 may include an integrally formed post 890 and cap 892. The body 880 may be formed from a first material, and the keys 882 may be formed from a second material. The cap 892 may be a rectangular or cubical block, for example. The post 890 may be a rectangular block having a plurality of protrusions 895 (e.g., cylindrical or rectangular protrusions) extending therefrom. In some configurations, the body 880 may be cast with the caps 892 placed in the casting mold such that the body 880 is are cast around the posts 890 (so as to embed the posts 890 and protrusions 895 inside of the body 880). In this manner, the caps 892 are fixedly secured to the body 880.

It will be appreciated that additional or alternative means could be utilized to attach the caps or keys to the body of any of the Oldham couplings 56, 156, 256, 356, 456, 556, 656, 756, 856. Such additional or alternative attaching means could include swaging, welding, brazing, shrink fitting, crimping, or snap fitting, for example.

Figure 16:
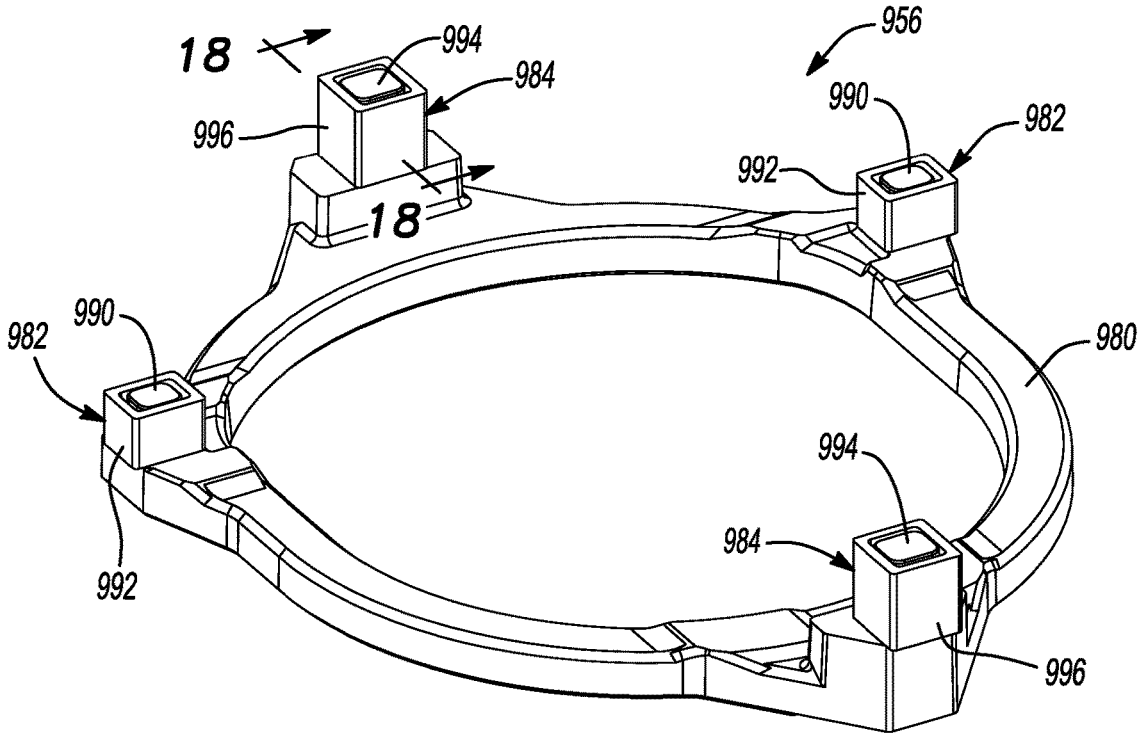
FIG. 16 is a perspective view of another Oldham coupling according to the principles of the present disclosure.
Figure 17:
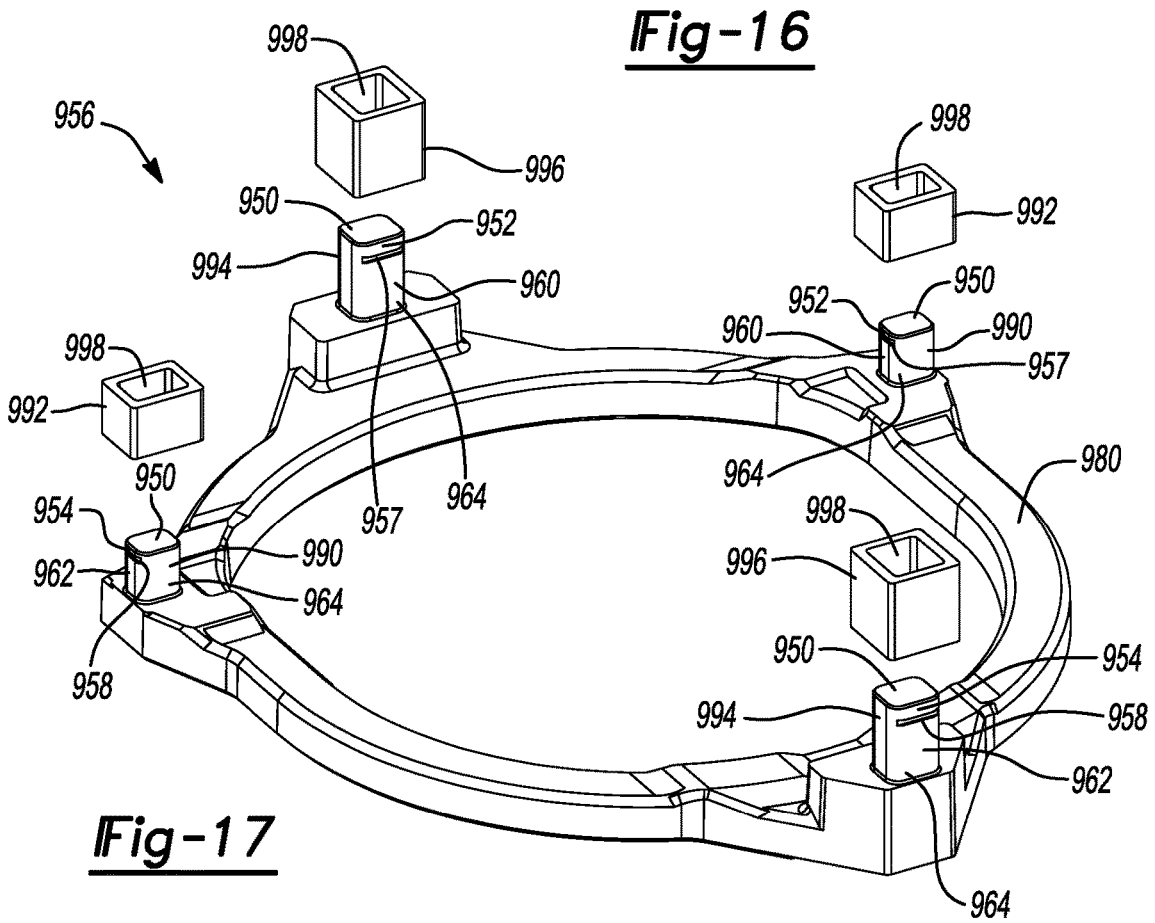
FIG. 17 is an exploded perspective view of the Oldham coupling of FIG. 16.
Figure 18:
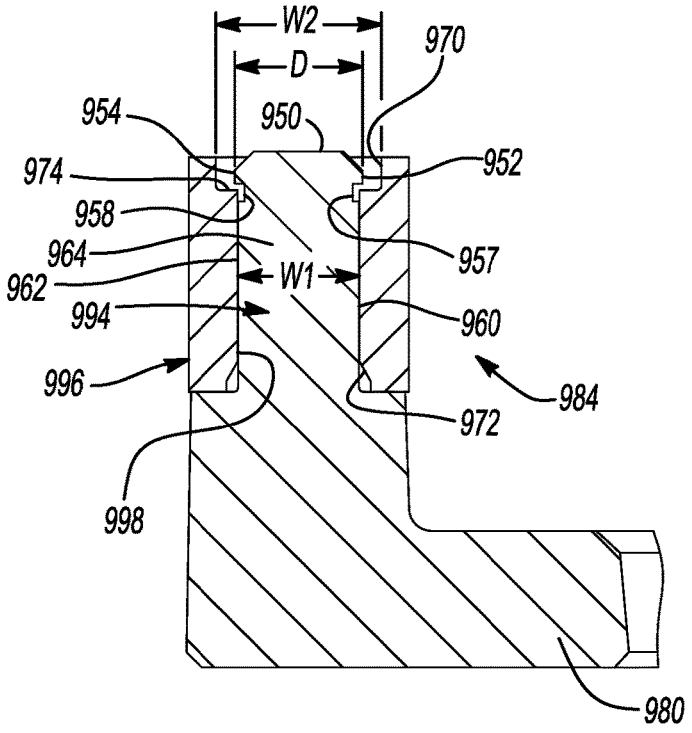
FIG. 18 is a partial cross-sectional view of the Oldham coupling of FIG. 16.
Figure 19:
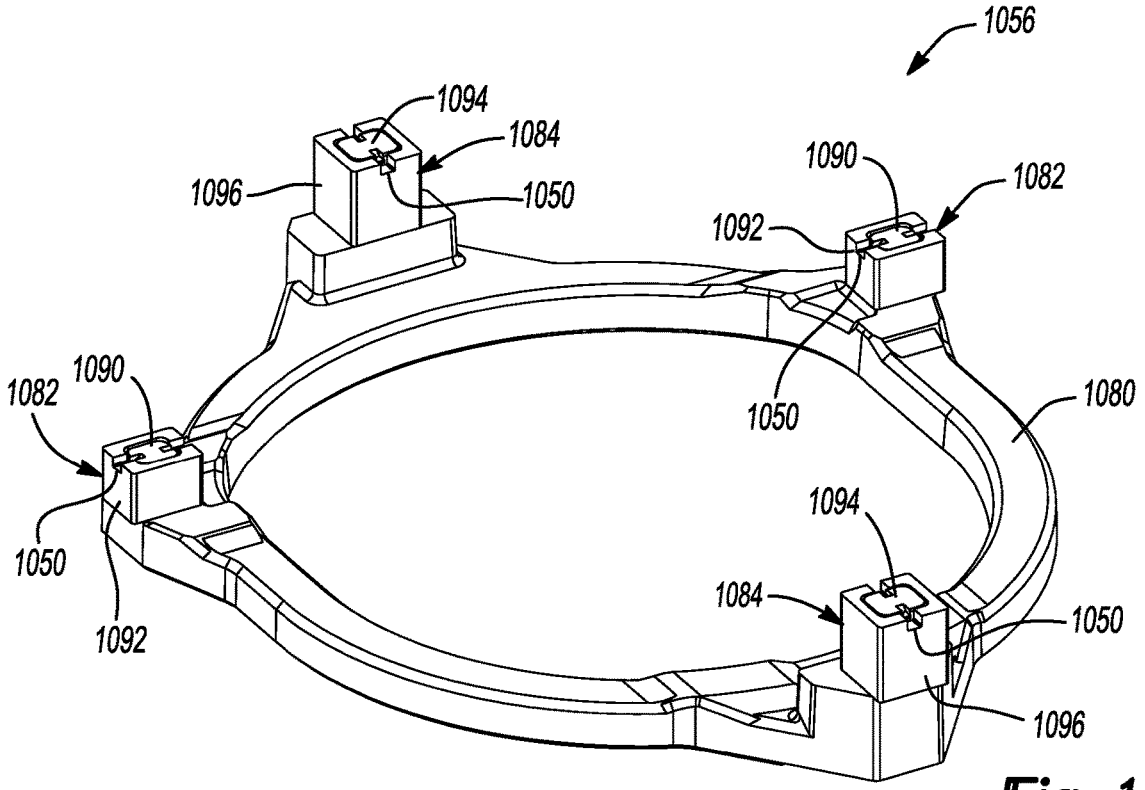
FIG. 19 is a perspective view of another Oldham coupling according to the principles of the present disclosure.

Referring now to FIGS. 16-18, another Oldham coupling 956 is provided that can be incorporated into the compressor 10 instead of the Oldham coupling 56. The structure and function of the Oldham coupling 956 can be similar or identical to that of the Oldham coupling 56, apart from the differences described below and/or shown in the figures.

As described above with respect to the Oldham coupling 56, the Oldham coupling 956 may include a generally annular body 980, a plurality of first keys 982 and a plurality of second keys 984. Like the keys 82, 84, the keys 982, 984 may include posts 990, 994 and caps 992, 996. The posts 990, 994 and body 980 may be formed from a first material, and the caps 992, 996 may be formed from a second material, as described above. As will be described in more detail below, the caps 992, 996 may receive the posts 990, 994 and may be retained thereon by snap-fit engagement with the posts 990, 994.

As shown in FIGS. 17 and 18, a distal end 950 (i.e., an end spaced apart from the body 980) of each of the posts 990, 994 include first and second flanges 952, 954 and first and second grooves 957, 958. The first flange 952 of each post 990, 994 is disposed on an inwardly facing side 960 of the post 990, 994. The second flange 954 of each post 990, 994 is disposed on an outwardly facing side 962 of the post 990, 994. The inwardly and outwardly facing sides 960, 962 face in opposite directions and extend from the body 980 to the distal end 950. The first grooves 957 may be formed in the inwardly facing sides 960 directly adjacent the first flanges 952 and between the body 980 and the first flanges 952. The second grooves 958 may be formed in the outwardly facing sides 962 directly adjacent the second flanges 954 and between the body 980 and the second flanges 954. As shown in FIG. 18, the first and second flanges 952, 954 extend laterally outward from the posts 990, 994 such that a distance D between lateral edges of the first and second flanges 952, 954 is greater than a width W1 of a main body 964 of the post 990, 994 in the same direction.

Each of the caps 992, 996 may include an aperture 998 that extends entirely through the cap 992, 996 and receives a corresponding one of the posts 990, 994. The posts 990, 994 may extend entirely through the apertures 998 or only partially through the apertures 998. As shown in FIG. 18, each of the apertures 998 includes a counterbore or recess 970 at one axial end and a countersink or chamfer 972 at the other axial end.

A portion of the aperture 998 disposed axially between the recess 970 and the chamfer 972 may have a width that is equal to or slightly larger than the width W1 of the main body 964 of the corresponding post 990, 994 and smaller than the distance D between lateral edges of the first and second flanges 952, 954 of the corresponding post 990, 994. The recess 970 has a width W2 that is larger than the distance D.

The caps 992, 996 can be installed onto the posts 990, 994 by pressing the caps 992, 996 onto the posts 990, 994. The distal end 950 of each post 990, 994 is initially inserted through the end of the aperture 998 that has the chamber 972. The chamfer 972 facilitates the initial insertion of the post 990, 994 into the aperture 998. The flanges 952, 954 may elastically deform into the grooves 957, 958 and/or the aperture 998 may expand as the flanges 952, 954 are pressed through the portion of the aperture 998 between the chamfer 972 and the recess 970. Once the flanges 952, 954 are inserted past an end surface 974 of the recess 970, the deformed flanges 952, 954 and/or aperture 998 may snap back to their original shape(s). Then, with the flanges 952, 954 and/or aperture 998 back in their original shape(s), interference between the flanges 952, 954 and the end surface 974 of the recess prevents the cap 992, 996 from sliding back off of the post 990, 994. The above means of attaching the caps 992, 996 to the posts 990, 994 are advantageous because insertion of the posts 990, 994 through the apertures 998 can be done with a relatively light amount of force (e.g., 0.1-0.3 kN of force) and without any special tooling.

While FIG. 18 shows a portion of the distal end 950 of the post 990, 994 protruding out of the end of the aperture 998, in some configurations, the entire post 990, 994 may be entirely received within the aperture 998 when the cap 992, 996 is fully installed on the post 990, 994 (i.e., the entire distal end 950 may be received within the recess 970).

Referring now to FIGS. 19-25, another Oldham coupling 1056 is provided that can be incorporated into the compressor 10 instead of the Oldham coupling 56. The structure and function of the Oldham coupling 1056 can be similar or identical to that of the Oldham coupling 56, apart from the differences described below and/or shown in the figures.

As described above with respect to the Oldham coupling 56, the Oldham coupling 1056 may include a generally annular body 1080, a plurality of first keys 1082 and a plurality of second keys 1084. Like the keys 82, 84, the keys 1082, 1084 may include posts 1090, 1094 and caps 1092, 1096. The posts 1090, 1094 and body 1080 may be formed from a first material, and the caps 1092, 1096 may be formed from a second material, as described above. As will be described in more detail below, the caps 1092, 1096 may receive the posts 1090, 1094 and may be retained thereon by swaging the posts 1090, 1094.

Figure 20:
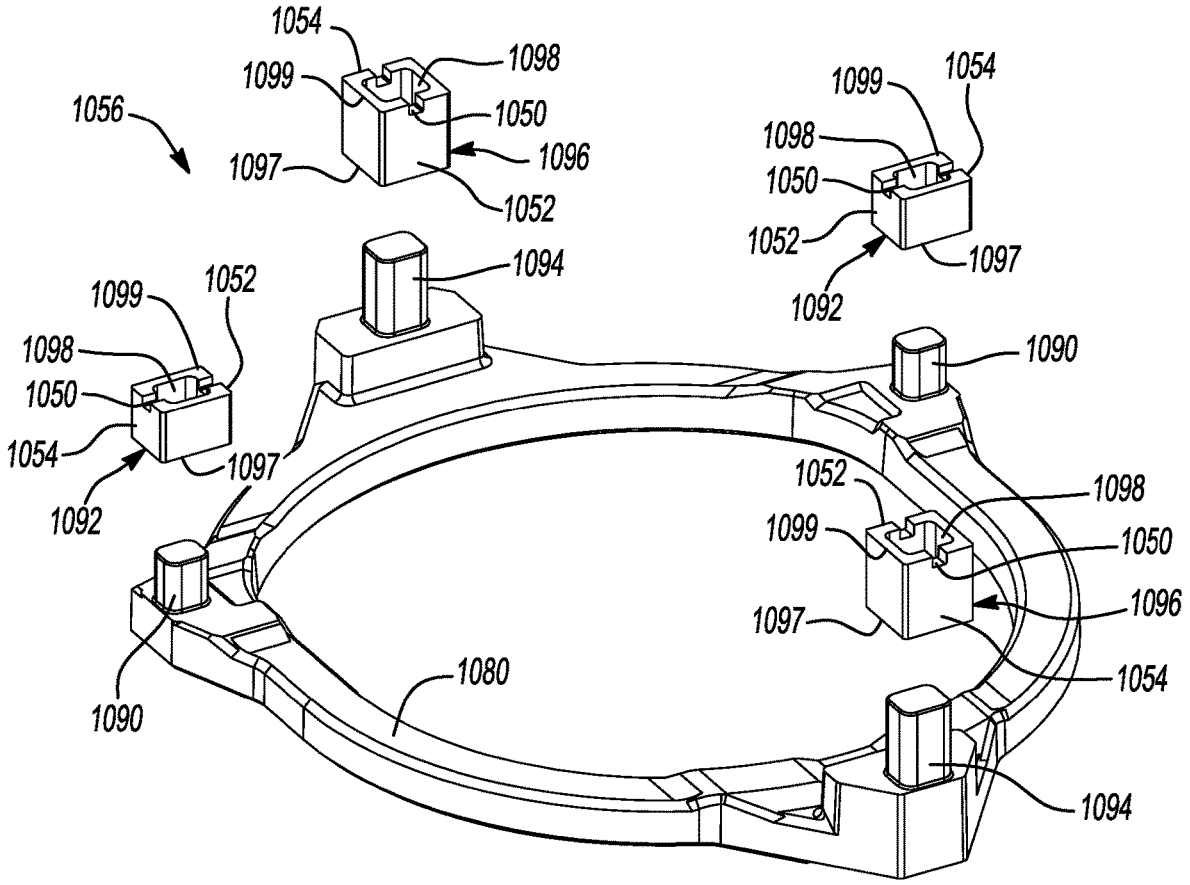
FIG. 20 is an exploded perspective view of the Oldham coupling of FIG. 19 in a pre-swaged condition.

As shown in FIG. 20, each of the caps 1092, 1096 may include an aperture 1098 extending entirely therethrough. That is, the aperture 1098 extends through a proximal end 1097 of the cap 1092, 1096 (i.e., the end adjacent the body 1080) and a distal end 1099 of the cap 1092, 1096 (i.e., the end furthest from the body 1080). The distal end 1099 of each cap 1092, 1096 may have a groove 1050 formed therein that intersects the aperture 1098 (i.e., extends laterally outward from opposite sides of the aperture 1098) and extends laterally through opposing sides 1052, 1054 of the cap 1092, 1096. While not shown in FIGS. 21-23, the aperture 1098 may include a chamfer (similar to chamfer 972) at the proximal end 1097 of the cap 1092, 1096 to facilitate insertion of the posts 1090, 1094 into the caps 1092, 1096.

Figure 23:
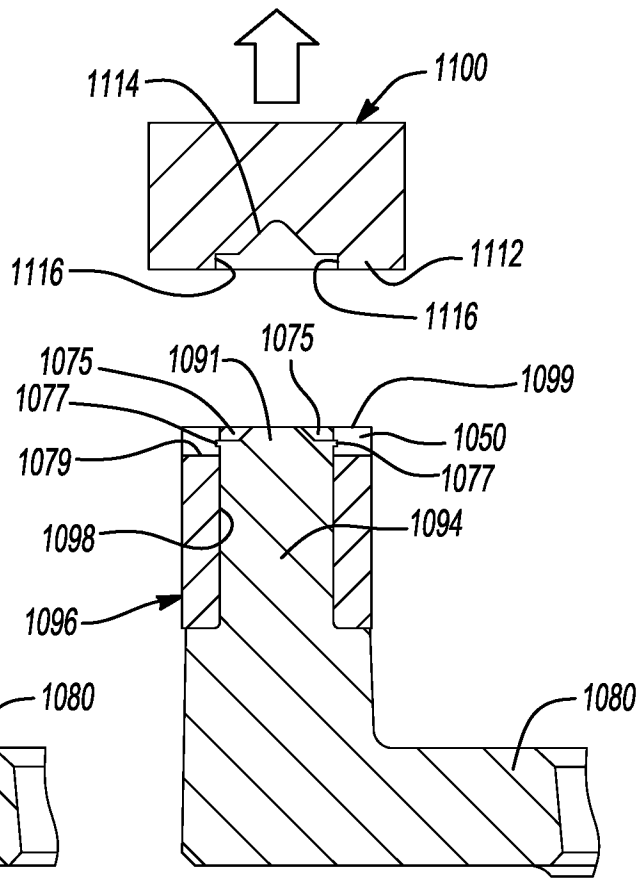
FIG. 23 is a cross-sectional view of the swaging tool being lifted off of the post after the post has been swaged.
Figure 22:
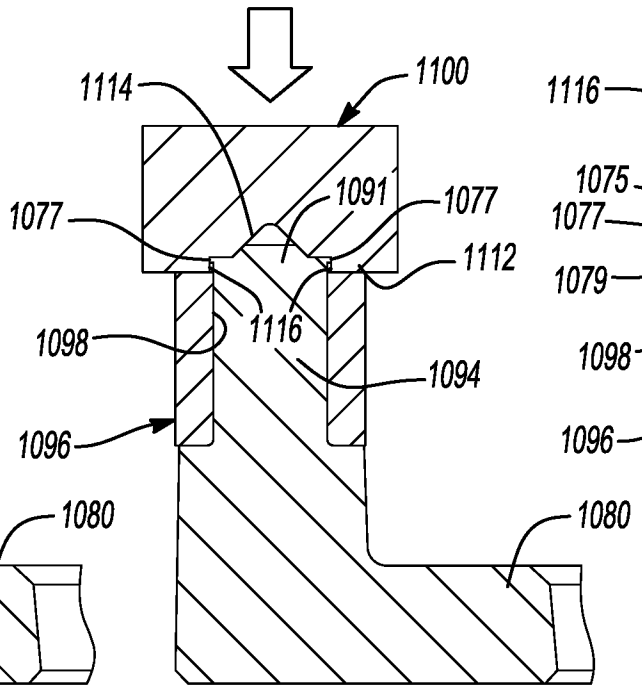
FIG. 22 is a cross-sectional view of the swaging tool being pressed onto the post.
Figure 21:
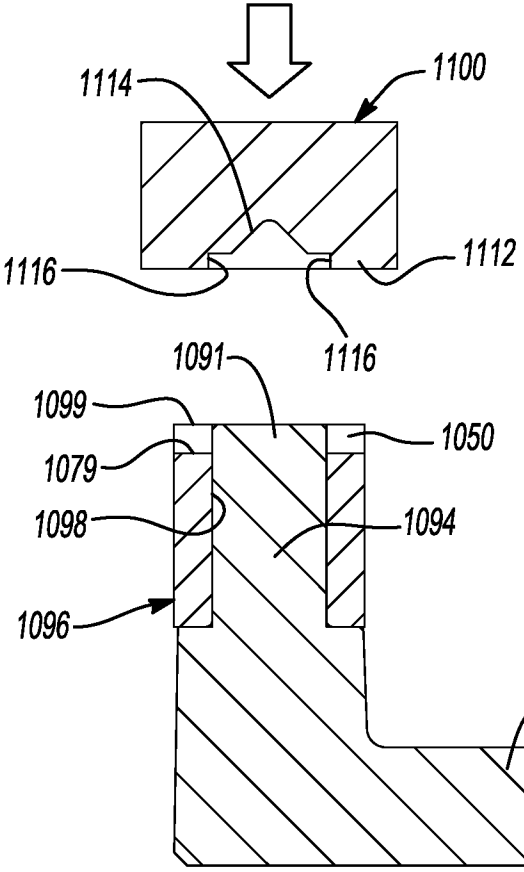
FIG. 21 is a cross-sectional view of a swaging tool and a portion of the Oldham coupling of FIG. 19 having a post in a pre-swaged condition.
Figure 24:
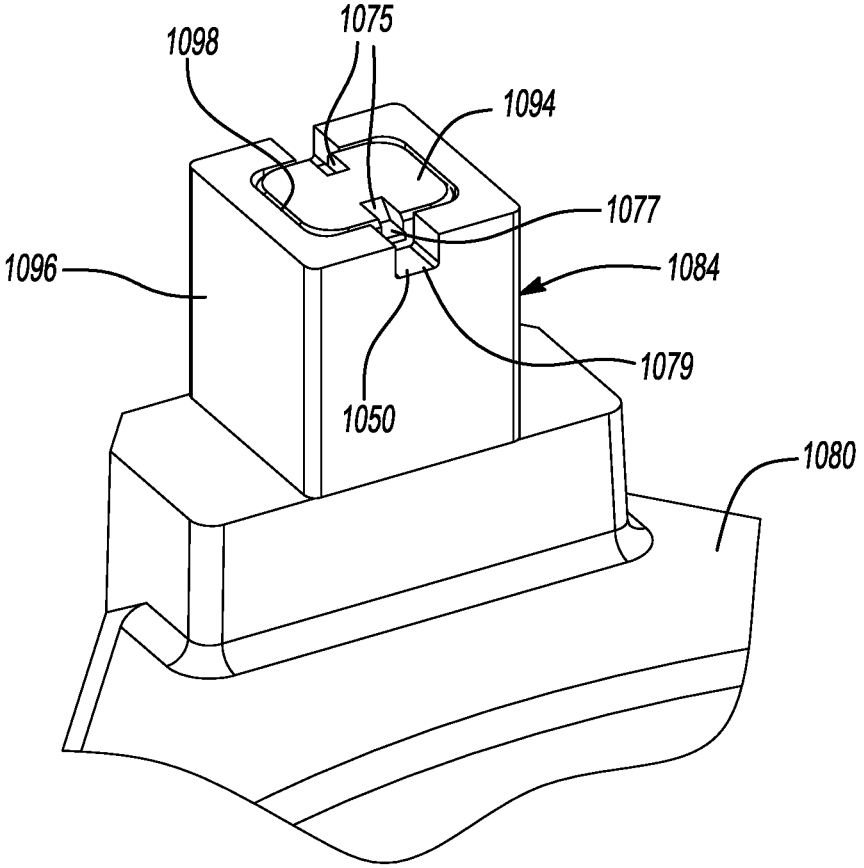
FIG. 24 is a partial perspective view of the Oldham coupling of FIG. 19 with the post in a swaged condition.

As shown in FIGS. 20 and 21, the posts 1090, 1094 may be initially cast and/or machined (or otherwise formed) to include a constant rectangular profile. With the posts 1090, 1094 in these initial constant-profile forms, the caps 1092, 1096 can easily slide onto the posts 1090, 1094, as shown in FIG. 21. Thereafter, a swaging tool 1100 can be used to swage or deform a distal end 1091 of each of the posts 1090, 1094, as shown in FIGS. 22 and 23.

Figure 25:
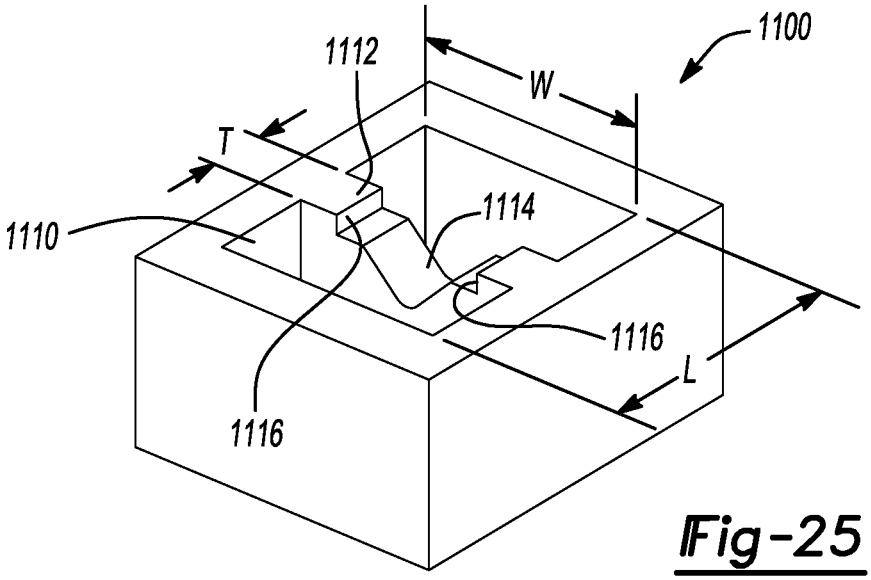
FIG. 25 is a perspective view of the swaging tool of FIGS. 21-23.

As shown in FIG. 25, the swaging tool 1100 may include a cavity 1110 and a rib 1112 disposed within the cavity 1110. A length L of the cavity 1110 and a width W of the cavity 1110 may be at least slightly larger than the length and width of the caps 1092, 1096 such that the distal end 1099 of the caps 1092, 1096 can be received in the cavity 1110. The rib 1112 has a thickness T that is slightly smaller than a thickness of the grooves 1050 in the caps 1092, 1096 such that the rib 1112 can be received in the grooves 1050 while the distal end 1099 of the caps 1092, 1096 is received in the cavity 1110. As shown in FIGS. 21-24, the rib 1112 may include a generally V-shaped central recess 1114 disposed between a pair of steps 1116. The spacing between the steps 1116 is such that the posts 1090, 1094 can be received between the steps 1116.

As described above and shown in FIG. 21, the caps 1092, 1096 can easily slide onto the posts 1090, 1094 while the posts 1090, 1094 are in their initial constant-profile forms (e.g., the as-cast or as-machined forms of the posts 1090, 1094). Thereafter, the swaging tool 1100 can be placed over the distal end 1099 of the cap 1092, 1096 with the distal end 1091 of the post 1090, 1094 received between the steps 1116 of the rib 1112, as shown in FIG. 22. Thereafter, a downward force can be applied to the swaging tool 1100 to press the rib 1112 into the distal end 1091 of the post 1090, 1094 to form notches 1075 and flanges 1077 (shown in FIGS. 23 and 24) in the post 1090, 1094. The distance between the outer lateral edges of the flanges 1077 is greater than the width of the aperture 1098 such that the flanges 1077 interfere with end walls 1079 of the groove 1050 in the cap 1092, 1096 to prevent the cap 1092, 1096 from sliding off of the post 1090, 1094.

The compressor 10 described above and shown in the figures is provided as an example of a compressor in which the Oldham couplings of the present disclosure may be incorporated. It will be appreciated that the teachings of the present disclosure can be incorporated into any type or configuration of scroll compressor.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a non-orbiting scroll;

an orbiting scroll meshingly engaged with the non-orbiting scroll;

a driveshaft having a crankpin engaging the orbiting scroll and driving the orbiting scroll in an orbital path relative to the non-orbiting scroll; and an Oldham coupling including an annular body and a plurality of first keys extending from the annular body and slidably received in first slots formed in the orbiting scroll, each of the first keys including a first post and a first cap engaging the first post, the first posts are integrally formed with the annular body from a first material, the first caps are formed from a second material, wherein:

each of the first posts includes a second slot, each of the first caps includes a pair of blocks and a cross-member extending between and interconnecting the blocks, the cross-members of the first caps are received in the second slots of respective ones of the first posts, and the blocks of the first caps at least partially shield the first posts from contact with the orbiting scroll in the first slots.

2. The compressor of claim 1, wherein the first caps are H-shaped.

3. The compressor of claim 2, wherein the blocks and cross-member of each of the first caps define a pair of third slots.

4. The compressor of claim 3, wherein each of the first posts includes a pair of protrusions that define the second slot.

5. The compressor of claim 4, wherein the protrusions of each of the first posts are received in respective ones of the third slots of a respective one of the first caps.

6. The compressor of claim 1, wherein the first caps are press fit into engagement with the first posts.

7. The compressor of claim 1, wherein the first caps are adhesively bonded with the first posts.

8. The compressor of claim 1, wherein the first posts are cast around portions of the first caps.

9. The compressor of claim 1, wherein distal edges of the first caps protrude further from the annular body than distal edges of the first posts.

10. The compressor of claim 1, wherein the Oldham coupling includes a plurality of second keys extending from the annular body, each of the second keys including a second post and a second cap engaging the second post, the second posts are integrally formed with the annular body from the first material, the second caps are formed from the second material.

11. A compressor comprising:

a non-orbiting scroll;

an orbiting scroll meshingly engaged with the non-orbiting scroll;

a driveshaft having a crankpin engaging the orbiting scroll and driving the orbiting scroll in an orbital path relative to the non-orbiting scroll; and an Oldham coupling including an annular body and a plurality of first keys extending from the annular body and slidably received in first slots formed in the orbiting scroll, each of the first keys including a first post and a first cap engaging the first post, the first posts are integrally formed with the annular body from a first material, the first caps are formed from a second material, wherein:

each of the first caps includes a pair of blocks and a cross-member that cooperate to form an H-shape, each of the first posts includes a second slot that receives the cross-member of a respective one of the first caps, and the first caps at least partially shield the first posts from contact with the orbiting scroll within the first slot.

12. The compressor of claim 11, wherein the blocks and cross-member of each of the first caps define a pair of third slots.

13. The compressor of claim 12, wherein each of the first posts includes a pair of protrusions that define the second slot.

14. The compressor of claim 13, wherein the protrusions of each of the first posts are received in respective ones of the third slots of a respective one of the first caps.

15. The compressor of claim 14, wherein the first posts are U-shaped.

16. The compressor of claim 11, wherein the first caps are press fit into engagement with the first posts.

17. The compressor of claim 11, wherein the first caps are adhesively bonded with the first posts.

18. The compressor of claim 11, wherein the first posts are cast around portions of the first caps.

19. The compressor of claim 11, wherein distal edges of the first caps protrude further from the annular body than distal edges of the first posts.

20. The compressor of claim 11, wherein the Oldham coupling includes a plurality of second keys extending from the annular body, each of the second keys including a second post and a second cap engaging the second post, the second posts are integrally formed with the annular body from the first material, the second caps are formed from the second material.

* * * * *